US005632218A

United States Patent [19]

Vaillancourt et al.

[11] Patent Number: 5,632,218

[45] Date of Patent: May 27, 1997

[54] DEBRIS DEFLECTOR

[75] Inventors: John J. Vaillancourt, Tiverton; Neil J. Dubois, Cranston; Stacy J. Hills, Newport, all of R.I.

[73] Assignee: The United States of America as represented by the Secretary of the Navy, Washington, D.C.

[21] Appl. No.: 695,843

[22] Filed: Aug. 5, 1996

[51] Int. Cl.[6] ..... B63B 59/02

[52] U.S. Cl. ..... 114/219; 114/332

[58] Field of Search ..... 114/40, 41, 126, 114/127, 140, 162, 221 R, 219, 312, 313; 440/71

[56] References Cited

U.S. PATENT DOCUMENTS 1,647,866 11/1927 Hozlak ..... 114/332
2,617,379 11/1952 De Beurs ..... 114/40

*Primary Examiner*—Jesus D. Sotelo
*Attorney, Agent, or Firm*—Michael J. McGowan; James M. Kasischke; Privthvi C. Lall

[57] ABSTRACT

A debris deflector protects an underwater vehicle's control. surface while introducing little or no flow disturbance around the control surface. The deflector extends outward from the vehicle to peninsulate the control surface. The deflector's cross-section is defined by a wedge shape subtended by an arc with the apex of the wedge shape always pointing towards the control surface.

20 Claims, 2 Drawing Sheets

DEBRIS DEFLECTOR

STATEMENT OF GOVERNMENT INTEREST

The invention described herein may be manufactured and used by or for the Government of the United States of America for Governmental purposes without the payment of any royalties thereon or therefor.

BACKGROUND OF THE INVENTION (1) Field of the Invention

The present invention relates generally to deflectors, and more particularly to a debris deflector for an underwater vehicle's control surface.

(2) Description of the Prior Art

Proper operation of a vehicle's control surface is critical. Underwater vehicles can encounter a large amount of debris that can get tangled in a control surface mechanism and reduce or destroy the vehicle's maneuverability. While one solution is to mount a debris deflector about the control surface, it is important that the debris deflector not impact the operation of the control surface by generating undesirable flow conditions.

SUMMARY OF THE INVENTION

Accordingly, it is an object of the present invention to provide a debris deflector for protecting an underwater vehicle's control surface.

Another object of the present invention is to provide a debris deflector for an underwater vehicle's control surface that produces minimal flow disturbance about the control surface.

Still another object of the present invention is to provide a debris deflector for an underwater vehicle's control surface that is simple in design and construction.

Other objects and advantages of the present invention will become more obvious hereinafter in the specification and drawings.

In accordance with the present invention, a debris deflector is provided to protect an underwater vehicle's control surface while introducing little or no flow disturbance around the control surface. The deflector is formed by a bar that extends outward from the vehicle to peninsulate the control surface. The bar has a cross-section defined by an angular wedge shape subtended by an arc. The apex of the angular wedge shape points towards the control surface as the bar peninsulates the control surface.

BRIEF DESCRIPTION OF THE DRAWING(S)

Other objects, features and advantages of the present invention will become apparent upon reference to the following description of the preferred embodiments and to the drawings, wherein.

DESCRIPTION OF THE PREFERRED EMBODIMENT(S)

Figure 1:
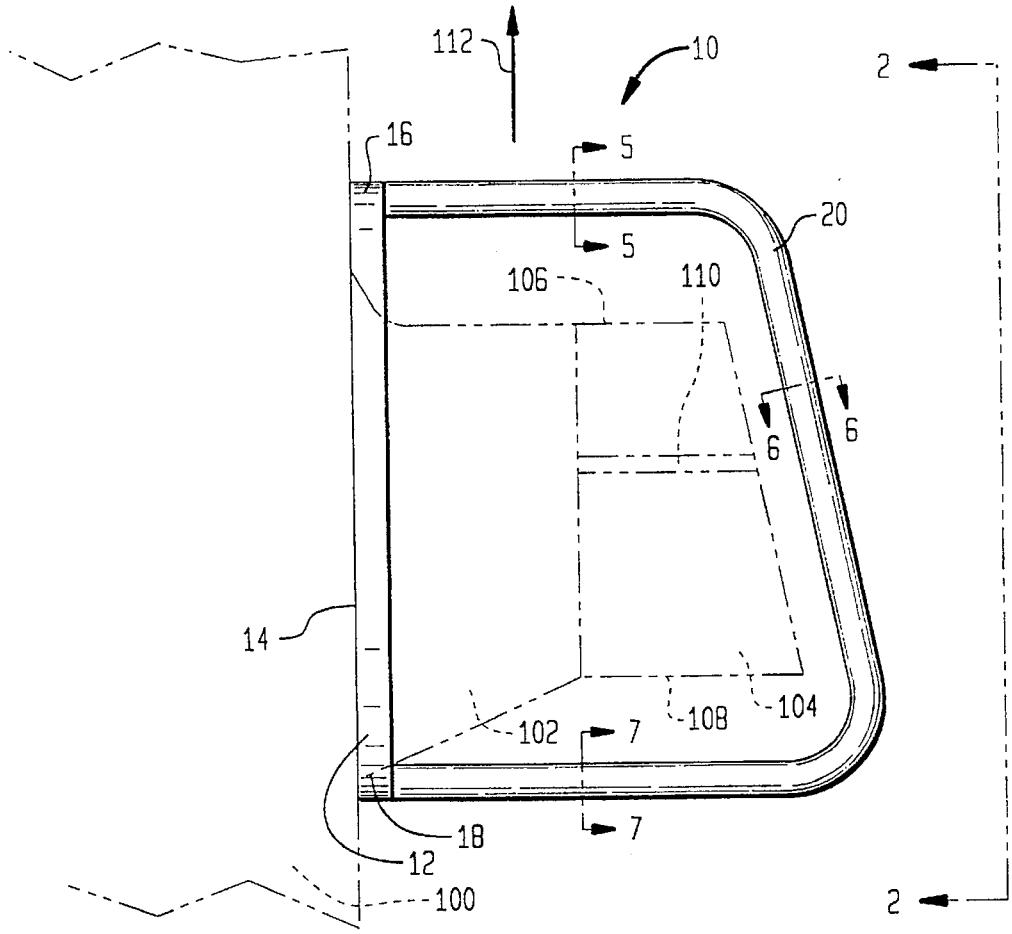
FIG. 1 is a side view of a portion an underwater vehicle and its control tower and control surface with the debris deflector of the present invention attached to the vehicle.
Figure 2:
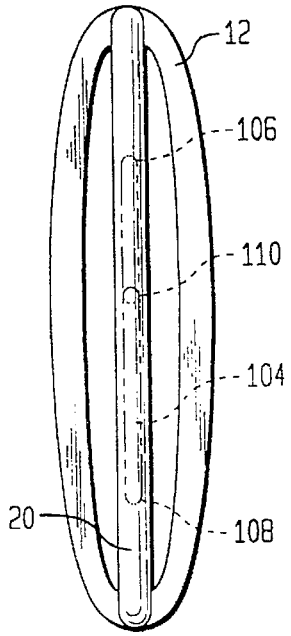
FIG. 2 is plan view of debris deflector taken along line 2—2 of FIG. 1.

Referring now to the drawings, simultaneous reference will be made to FIGS. 1 and 2 where like reference numerals will be used for common elements in the different views. In FIG. 1, the debris deflector of the present invention is shown and is referenced generally by numeral 10. Debris deflector 10 is attached to an underwater vehicle 100 shown in phantom. Vehicle 100 can be any manned or unmanned vehicle. By way of example, vehicle 100 is shown with a stationary control surface tower 102 serving as the structural support for a movable control surface 104. Typically, control surface 104 is a relatively flat control surface that is pivotally mounted to control surface tower 102 about shaft 110 such that control surface 104 has a free leading edge 106 and a free trailing edge 108. Control surface 104 rotates on shaft 110 through an overall angle of motion of, for example, 60°. Thus, when vehicle 100 is moving in the direction of arrow 112, debris (not shown) can get caught between control surface 104 and control surface tower 102. It is to be understood that the present invention could also be utilized with a control surface depending directly from the vehicle, i.e., without the structural support of a control surface tower.

Debris deflector 10 is constructed from a base 12 and a shaped bar 20. Both base 12 and shaped bar 20 are made from corrosion resistant materials such as aluminum, non-metallic composites and the like, the choice of which is not a limitation of the present invention. Base 12 is contoured along its bottom face 14 to form a substantially flush fit with vehicle 100. For stability, base 12 is shaped to circumscribe control surface tower 102 as is best seen in the plan view of FIG. 2. Base 12 is fixably attached, e.g., bolted, to vehicle 100. A gasket (not shown) can be placed between face 14 and vehicle 100 to improve the fit or reduce the manufacturing tolerances for the surface of face 14.

Shaped bar 20 is fixably attached, e.g., welded, to base 12 at the fore and aft ends 16 and 18, respectively, of base 12 where the fore and aft ends are defined relative to direction of travel 112. Fore end 16 can be tapered or faired in the direction of travel 112 to further reduce flow disturbance if control surface 104 depends directly from vehicle 10.

Figure 3:
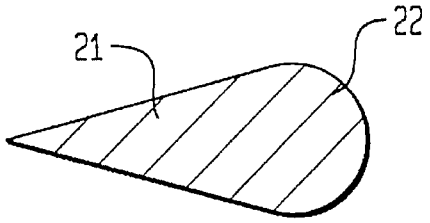
FIG. 3 is a cross-sectional view of a preferred embodiment of the shaped bar portion of the debris deflector.
Figure 4:
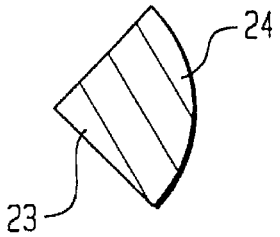
FIG. 4 is a cross-sectional view of another embodiment of the shaped bar portion of the debris deflector.

Shaped bar 20 extends out from vehicle 100 and essentially peninsulates control surface tower 102 and control surface 104. To minimize flow disturbances about control surface 104, bar 20 lies in a single plane that is co-planar with shaft 110 as is best seen in FIG. 2. In addition, the cross-sectional shape of bar 20 is critical in order to minimize flow disturbances (e.g., vortex shedding) in the vicinity of control surface 104. A preferred cross-sectional shape for the debris deflector is shown in FIG. 3 where a wedge-shaped portion 21 is subtended by a curve portion 22. Although not essential, curve portion 22 should join wedge-shaped portion 21 to form a continuously smooth outer surface for optimum performance. Curve portion 22 can be circular, elliptical, parabolic or some other shape. For example, the wedge-shaped and curved portions can be such as the cross-sectional shape shown in FIG. 4. In the embodiment depicted in FIG. 4, wedge-shaped portion 23 and arc portion 24 form approximately a quarter circle. This is advantageous owing to the ready availability of solid (as shown) or hollow round stock that can be machined and shaped to form bar 20. However, the present invention is not so limited. The cross-sectional shape could be less than a quarter circle although the advantages afforded by the present invention are expected to decrease if the angle formed by the wedged-shaped portion is approximately 10° or less. In general, the cross-sectional shape of bar 20 is formed from any angular wedge-shaped portion of approximately 90° or less that is subtended by a gradual arc portion.

Figure 5:
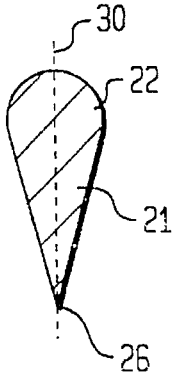
FIG. 5 is a cross-sectional view of the shaped bar portion of the debris deflector taken along line 5—5 of FIG. 1.
Figure 6:
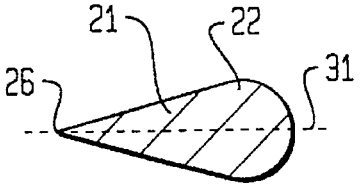
FIG. 6 is a cross-sectional view of the shaped bar taken along line 6—6 of FIG. 1.
Figure 7:
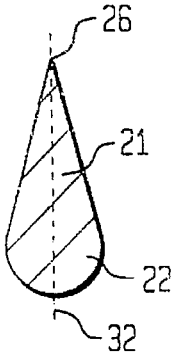
FIG. 7 is a cross-sectional view of the shaped bar taken along line 7—7 of FIG. 1.

Regardless of the particular cross-sectional shape of bar 20, the apex of the wedge-shaped portion is pointed towards control surface 104 as bar 20 traverses thereabout. This is best seen by reviewing the three cross-sectional views depicted in FIGS. 5, 6 and 7 where apex 26 of wedge-shaped portion 21 is pointed towards control surface 104 as bar 20 traverses thereabout. Wedged-shaped portion 21 is also symmetric with respect to shaft 110 such that one-half of wedge-shaped portion 21 falls on either side of shaft 110 for all of bar 20. In other words, center lines 30, 31 and 32 in the respective FIGS. 5, 6 and 7 are co-planar with one another and are co-planar with shaft 110.

The advantages of the present invention are numerous. The debris deflector has proven in testing to protect an underwater vehicle's control surface while introducing little or no flow disturbance around the control surface. The design is simple and easy to construct and lends itself to retrofit applications.

It will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. A debris deflector for protecting a control surface that extends outward from a control surface tower, said debris deflector comprising:

a base mounted about the control surface tower; and a bar attached to said base and extending outward from said base to peninsulate the control surface tower and the control surface, said bar having a cross-section defined by a wedge shape subtended by a curve, said wedge shape having an apex pointing towards the control surface tower and the control surface as said bar peninsulates thereabout.

2. A debris deflector as in claim 1 wherein said bar has a cross-section defined by a wedge shape subtended by a circular arc.

3. A debris deflector as in claim 2 wherein said circular arc and said wedge shape at said apex have the same angular measurements.

4. A debris deflector as in claim 1 wherein said bar lies in a single plane.

5. A debris deflector as in claim 4 wherein a mounting shaft extends outward from the Control surface tower and the control surface is attached to the shaft for rotation thereabout, wherein said bar and said shaft are co-planar.

6. A debris deflector as in claim 5 wherein said curve is symmetric with respect to the shaft.

7. A debris deflector as in claim 1 wherein said cross-section of said bar defines approximately a quarter of a circle.

8. A debris deflector as in claim 1 wherein said base and said bar are made of corrosion resistant material.

9. A debris deflector for protecting an underwater vehicle's control surface that pivots about a shaft extending outward from the vehicle's control surface tower, said debris deflector comprising:

a contoured base mounted in a substantially flush fit fashion to the vehicle about the control surface tower; and a shaped bar attached to said contoured base and extending outward from the vehicle, said shaped bar lying in substantially the same plane as the shaft, said shaped bar further having a cross-section defined by a wedge shape subtended by a curve, said wedge shape having an apex continually pointing towards the control surface tower and the control surface.

10. A debris deflector as in claim 9 wherein said shaped bar lies in a single plane.

11. A debris deflector as in claim 9 wherein said contoured base and said shaped bar are made of corrosion resistant material.

12. A debris deflector as in claim 9 wherein said cross-section of said bar defines approximately a quarter of a circle.

13. A debris deflector for protecting an underwater vehicle's control surface, said debris deflector comprising a bar extending outward from the vehicle to peninsulate the control surface, said bar having a cross-section defined by a wedge shape subtended by an arc, said wedge shape having an apex pointing towards the control surface as said bar peninsulates thereabout.

14. A debris deflector as in claim 13 further comprising a base mounted to the vehicle about the control surface and contoured for a substantially flush fit with the vehicle, wherein said bar is attached to said base.

15. A debris deflector as in claim 13 wherein said bar lies in single plane.

16. A debris deflector as in claim 15 wherein the control surface is attached to a shaft for rotation thereabout, and wherein said bar and the shaft are co-planar.

17. A debris deflector as in claim 16 wherein said wedge shape is symmetric with respect to the shaft.

18. A debris deflector as in claim 13 wherein said wedge shape defines an angle of not more than approximately 90°.

19. A debris deflector as in claim 13 wherein said wedge shape defines an angle of approximately 90°.

20. A debris deflector as in claim 13 wherein said bar is made of corrosion resistant material.

* * * * *